US005347210A

United States Patent [19]

Nguyen

[11] Patent Number: 5,347,210

[45] Date of Patent: Sep. 13, 1994

[54] CURRENT SWITCH WITH BIPOLAR SWITCHING TRANSISTOR AND $\beta$ COMPENSATING CIRCUIT

[75] Inventor: Baoson Nguyen, Plano, Tex.

[73] Assignee: Texas Instruments Incorporated, Dallas, Tex.

[21] Appl. No.: 40,763

[22] Filed: Mar. 31, 1993

[51] Int. Cl.[5] ..... G05F 3/16

[52] U.S. Cl. ..... 323/315; 323/312; 307/296.6

[58] Field of Search ..... 323/312, 313, 314, 315; 307/296.1, 296.2, 296.6, 296.8

[56] References Cited

U.S. PATENT DOCUMENTS 4,528,496 7/1985 Naokawa et al. ..... 323/315
4,730,124 3/1988 Metz ..... 323/315 X
4,879,505 11/1989 Barrow et al. ..... 323/312

*Primary Examiner*—Steven L. Stephan
*Assistant Examiner*—Y. Jessica Han
*Attorney, Agent, or Firm*—Wade James Brady; Richard L. Donaldson

[57] ABSTRACT

A current switch (30) includes a switching transistor (Q1) having a collector electrode for coupling to a first voltage source (Vcc), an emitter electrode, and a base electrode for receiving a control signal ($V_{IN1}$). Switching transistor (Q1) is responsive to the control signal ($V_{IN1}$) to turn on to produce a collector current ($I_{CQ1}$). A bias circuit (26) is coupled to the emitter electrode of the switching transistor (Q1) for causing the collector current ($I_{CQ1}$) of the switching transistor (Q1) to have a predetermined value. The bias circuit includes first and second transistors (Q3 and Q4) having base electrodes coupled in common. The first transistor (Q3) has a collector electrode coupled to the emitter electrode of the switching transistor (Q1) and an emitter electrode for coupling to a second voltage source (Vss). The second transistor has a collector electrode for coupling to a current source (24) and an emitter electrode for coupling to the second voltage source (Vss). A third transistor (Q6) has a collector electrode coupled to the emitter electrode of the switching transistor (Q1), a emitter electrode coupled to the base electrode of the first transistor (Q3), and a control electrode coupled to the collector electrode of the second transistor (Q4). The third transistor (Q6) reduces the dependance of the collector current ($I_{CQ1}$) on the $\beta$ of the switching transistor (Q1) to make the collector current ($I_{CQ1}$) less sensitive to process variations.

18 Claims, 2 Drawing Sheets

CURRENT SWITCH WITH BIPOLAR SWITCHING TRANSISTOR AND $\beta$ COMPENSATING CIRCUIT

FIELD OF THE INVENTION

This invention relates generally to semiconductor devices and, more particularly, to current switches having bipolar switching transistors.

BACKGROUND OF THE INVENTION

Transistors are often used in switching circuits to perform a current switching function in order to selectively supply current to loads in response to control signals. In such switching circuits, the switching transistors typically having a current path coupled between a load and a bias network that includes a constant current source. The control electrode of each switching transistor receives a control signal to selectively turn that switching transistor on to switch a current determined by the bias network to the associated load.

In presently available current switches in which the switching transistors are bipolar transistors, the current switched to a load is dependent upon the switching transistor's current gain $\beta$. Since $\beta$ varies significantly as a result of process variations, the value of the current switched to the load is also subject to process variations. The complete elimination of all process variations is extremely difficult. As a result, $\beta$ can typically be guaranteed only to be within a fairly broad range thus making it impossible to predict with a high degree of accuracy what the value of the switched current will actually be.

This inability to switch a known, very accurate current is undesirable in a wide variety of devices, such as oscillators using current ramping techniques, accurate clock duty cycle control circuits, and transconductance amplifiers, that require accurate current switching capability.

Accordingly, a need exists for a current switch having bipolar switching transistors that has reduced sensitivity to process variations and can switch a predetermined current with a high degree of accuracy.

SUMMARY OF THE INVENTION

Generally, and in one form of the invention, a current switch includes a switching transistor having a collector electrode for coupling to a first voltage source, an emitter electrode, and a base electrode for receiving a control signal. The switching transistor is responsive to the control signal to turn on to produce a collector current. The current switch also includes a bias circuit for causing the collector current to have a predetermined value when the switching transistor is on. The bias circuit includes first and second transistors having base electrodes coupled in common, the first transistor having a collector electrode coupled to the emitter electrode of the switching transistor and an emitter electrode for coupling to a second voltage source, the second transistor having a collector electrode for coupling to a current source and an emitter electrode for coupling to the second voltage source. The bias circuit also includes a third transistor having a collector electrode coupled to the emitter electrode of the switching transistor, an emitter electrode coupled to the base electrode of the first transistor, and a base electrode coupled to the collector electrode of the second transistor.

In another form of the invention, a field effect transistor is used as the third transistor with its drain coupled to the emitter of the switching transistor, source coupled to the base of the first transistor, and gate coupled to the collector of the second transistor.

An advantage of the invention is that as a result of the third transistor, the current switched by the switching transistor has a reduced dependence on the $\beta$ of the switching transistor when compared with the current switched by conventional current switch circuits. The reduction in $\beta$ dependence results in a switched current that is much less sensitive to process variations and can therefore be predicted with a very high degree of accuracy.

BRIEF DESCRIPTION OF THE DRAWINGS

In the drawings.

Corresponding numerals and symbols in the different figures refer to corresponding parts unless otherwise indicated.

DETAILED DESCRIPTION OF THE PREFERRED EMBODIMENTS

Figure 1:
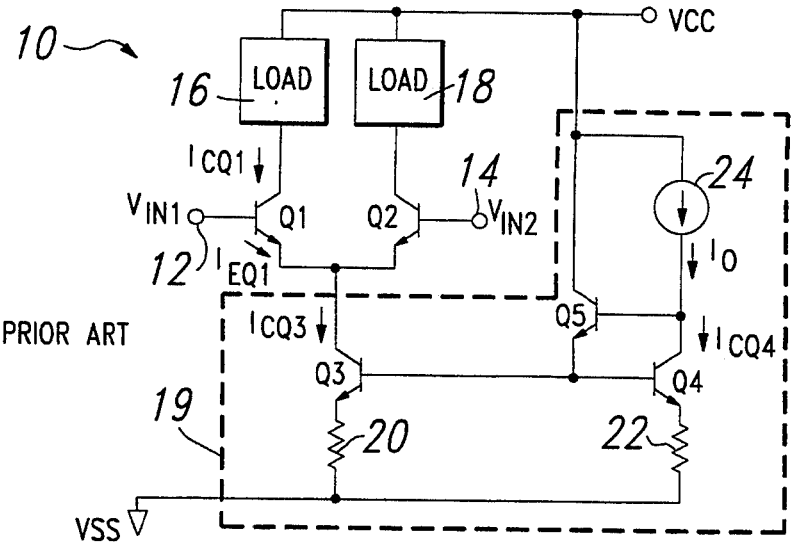
Fig. 1 PRIOR ART
FIG. 1 is an electrical schematic diagram of a prior art current switching circuit.

FIG. 1 shows a conventional integrated circuit current switch 10 having a differential pair of identical bipolar NPN switching transistors Q1 and Q2. Transistor Q1 has a base electrode coupled to input terminal 12 to receive input signal $V_{IN1}$ and a collector electrode coupled to a first voltage source Vcc through load 16. Transistor Q2 has a base electrode coupled to input terminal 14 to receive input signal $V_{IN2}$ and a collector electrode coupled to voltage source Vcc through load 18.

Input signals $V_{IN1}$ and $V_{IN2}$ selectively have either a first state or a second state. Transistor Q1 is turned on in response to the first state of signal $V_{IN1}$ to switch a collector current $I_{CQ1}$ to load 16 and turned off in response to the second state of signal $V_{IN1}$ to prevent current flow to load 16. Transistor Q2 is turned on in response to the first state of signal $V_{IN2}$ to switch a collector current $I_{CQ2}$ to load 18 and turned off in response to the second state of signal $V_{IN2}$ to prevent current flow to load 18. Input signals $V_{IN1}$ and $V_{IN2}$ may be chosen so as to permit only one of transistors Q1 and Q2 to be on at any one time or to permit transistors Q1 and Q2 to be on simultaneously.

The emitter electrodes of transistors Q1 and Q2 are coupled in common to the collector electrode of transistor Q3 of a bias circuit 19 that determines the value of collector currents $I_{CQ1}$ and $I_{CQ2}$ that will be switched to loads 16 and 18 when transistors Q1 and Q2 are turned on. Bias circuit 19 includes transistors Q3 and Q4 having emitter electrodes coupled to second voltage source Vss through resistors 20 and 22, respectively. The base electrodes of transistors Q3 and Q4 are coupled to the emitter electrode of transistor Q5. The collector electrode of transistor Q5 is coupled to voltage source Vcc. The collector electrode of transistor Q4 and base electrode of transistor Q5 are coupled to voltage source Vcc through constant current source 24. Current source 24 produces a known, very accurate constant reference current $I_0$.

Transistors Q3, Q4 and Q5 form a current mirror in which the collector current of Q4, $I_{CQ4}$, is mirrored by the collector current of Q3, $I_{CQ3}$. The emitter area of Q5 is the same as the emitter area of Q4. The emitter area of Q3 is scaled to be n times the size of the emitter area of Q4, where n may be any number but is typically greater than one. Resistor 22 is also n times the value of resistor 20. The emitter area and resistor scaling results in $I_{CQ3}$ being n times as large as $I_{CQ4}$.

In the following analysis, $I_{CQN}$ is the collector current, $I_{EQN}$ is the emitter current, $I_{BQN}$ is the base current, and $\beta_{QN}$ is the current gain of a transistor QN, where N is a number identifying a particular transistor; n is the emitter scaling factor. Since current switch 10 is an integrated circuit, all bipolar transistors have substantially the same values of $\beta$.

When it is desired to switch current only to load 16, $V_{IN1}$ has the first state and $V_{IN2}$ has the second state so that Q1 is on and Q2 is off.

Since the transistor Q5 of the current mirror is bipolar:

$$I_{CQ4}=I_0-I_{BQ5} \quad 1.$$

Since $I_{BQ5}\approx I_{EQ5}/(\beta_{Q5})$:

$$I_{CQ4}\approx I_0-I_{EQ5}/(\beta_{Q5}) \quad 2.$$

Since $I_{EQ5}=I_{BQ3}+I_{BQ5}$ and $I_{BQ3}=nI_{BQ4}$:

$$I_{CQ4}\approx I_0-(nI_{BQ4}+I_{BQ4})/(\beta_{Q5})\approx I_0-I_{BQ4}(n+1)/(\beta_{Q5}) \quad 3.$$

Since $I_{BQ4}\approx I)/\beta_{Q4}$:

$$I_{CQ4}\approx I_0-I_0(n+1)/\beta_{Q4}(\beta_{Q5})\approx I_0[1-(n+1)/\beta_{Q4}\beta_{Q5}] \quad 4.$$

Since $\beta_{Q4}\approx\beta_{Q5}$:

$$I_{CQ4}\approx I_0[1-(n+1)/\beta^2] \quad 5.$$

For typical values of $\beta$ and where n is less than $\beta$ (n is typically only a fraction of $\beta$), the value of $(n+1)/\beta^2$ is very small and the error introduced in $I_{CQ4}$ by neglecting its dependence on $\beta$, that is, by neglecting the portion $-I_0(n+1)/\beta^2$, is negligible. Therefore, in the following analysis of current switch 10, it will be assumed that:

$$I_{CQ4}=I_0 \quad 6.$$

Since Q3 mirrors Q4 and is emitter-scaled by a factor of n:

$$I_{CQ3}=nI_{CQ4}=nI_0 \quad 7.$$

Since Q1 is on and Q2 is off:

$$I_{EQ1}=I_{CQ3}=nI_0 \quad 8.$$

Since the sum of currents at a node of 0:

$$I_{CQ1}=I_{EQ1}-I_{BQ1} \quad 9.$$

Since the $I_{BQ1}\approx I_{EQ1}/\beta_{Q1}$:

$$I_{CQ1}\approx I_{EQ1}-I_{EQ1}/\beta_{Q1}\approx I_{EQ1}(1-1/\beta_{Q1})\approx nI_0(1-1/\beta_{Q1}) \quad 10.$$

As seen in equation 10, in current switch 10 of FIG. 1 a portion of the switched current or current through load 16, $I_{CQ1}$, is dependent upon $\beta_{Q1}$. Since the process variations typically encountered in integrated circuit manufacturing can result in significant, unpredictable changes in $\beta$, that portion of the switched current $I_{CQ1}$ of current switch 10 dependent upon $\beta_{Q1}$, $-nI_0/\beta_{Q1}$, is also unpredictable.

Figure 2:
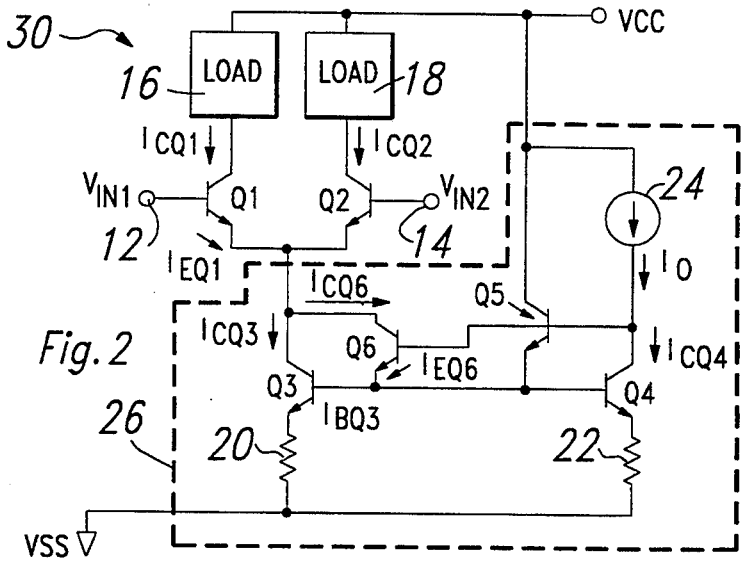
FIG. 2 is an electrical schematic diagram of a current switching circuit according to a first embodiment of the invention.

FIG. 2 shows an integrated circuit current switch 30 according to a first embodiment of the invention. Current switch 30 is identical to current switch 10 of FIG. 1 with the exception that an additional transistor Q6 is provided. Transistor Q6 has a collector electrode coupled to the collector electrode of transistor Q3, an emitter electrode coupled to the base electrode of transistor Q3, and a base electrode coupled in common with the base electrode of transistor Q5. The emitter of transistor Q6 is the same size as the emitter of transistor Q3.

Elements Q3, Q4, Q5, Q6, 20, 22, and 24 form a bias circuit 26 which causes collector currents $I_{CQ1}$ and $I_{CQ2}$ to have predetermined values when transistors Q1 and Q2 are on. Transistor Q6 provides $\beta$ compensation for switching transistors Q1 and Q2 to permit them to switch currents $I_{CQ1}$ and $I_{CQ2}$, respectively, that are substantially less dependent on $\beta$ and therefore much less sensitive to process variations as demonstrated by the following analysis.

When it is desired to switch current only to load 16, $V_{IN1}$ has the first state and $V_{IN2}$ has the second state so that Q1 is on and Q2 is off.

Since the transistor Q5 of the current mirror is bipolar:

$$I_{CQ4}=I_0-(I_{BQ5}+I_{BQ6}) \quad 11.$$

Since $I_{BQ5}\approx I_{EQ5}/(\beta_{Q5})$ and $I_{BQ6}=nI_{BQ5}$:

$$I_{CQ4}\approx I_0-(I_{EQ5}+nI_{EQ5})/\beta_{Q5} \quad 12.$$

Since $I_{EQ5}=I_{IBQ4}$ $$I_{CQ4}\approx I_0-(I_{BQ4}+nI_{BQ4})/(\beta_{Q\%})\approx I_0-I_{BQ4}(n+1)/(\beta_{Q5}) \quad 13.$$

Since $I_{BQ4}\approx I_0/\approx_{Q4}$:

$$I_{CQ4}\approx I_0-I_0(n+1)/\approx_{Q4}(\beta_{Q5})\approx I_0[1-(n+1)/\beta_{Q4}\beta_{Q5} \quad 14.$$

Since $\beta_{Q4}\approx\beta_{Q5}$:

$$I_{CQ4}\approx_{I0}[1-(n+1)/\beta^2] \quad 15.$$

The error in $I_{CQ4}$ relative to $I_0$ is the same as in FIG. 1. Therefore, for typical values of $\beta$ and n, the value of $(n+1)/\beta^2$ is very small and the error introduced in $I_{CQ4}$ by neglecting its dependence on $\beta$ is negligible. Therefore, in the following analysis of current switch 30, it will be assumed that:

$$I_{CQ4}=I_0 \quad 16.$$

Since Q3 mirrors Q4 and is emitter-scaled by a factor of n:

$$I_{CQ3}=nI_{CQ4}=nI_0 \quad 17.$$

Since the sum of currents at a node is 0:

$$I_{EQ1}=I_{CQ3}+I_{CQ6} \quad 18.$$

Since $I_{CQ6}\approx I_{EQ6}$ and since $I_{EQ6}=I_{BQ3}$:

$$I_{EQ1}\approx I_{CQ3}+I_{BQ3} \quad 19.$$

Since $I_{BQ3}=I_{CQ3}/\beta_{Q3}$:

$$I_{EQ1}\approx I_{CQ3}+I_{CQ3}/\beta_{Q3}\approx I_{CQ3}(1+1/\beta_{Q3}) \quad 20.$$

Since the sum of currents at a node is 0:

$$I_{CQ1}=I_{EQ1}-I_{BQ1} \quad 21.$$

Since $I_{BQ1}\approx I_{EQ1}/\beta_{Q1}$:

$$I_{CQ1}\approx I_{EQ1}-I_{EQ1}/\approx_{Q1}\approx I_{EQ1}(1-1/\beta_{Q1}) \quad 22.$$

Substituting for $I_{EQ1}$ from equation 20:

$$I_{CQ1}\approx I_{CQ3}(1+1/\beta_{Q3})(1-1/\beta_{Q1}) \quad 23.$$

Since $\beta_{Q3}\approx\beta_{Q1}$:

$$I_{CQ1}\approx I_{CQ3}(1-1/\beta^2) \quad 24.$$

Substituting for $I_{CQ3}$ from equation 17:

$$I_{CQ1}\approx nI_0(1-1/62\ ^2) \quad 25.$$

As seen in equation 25, in current switch 30 of FIG. 2 the portion of the switched current or current through load 16, $I_{CQ1}$, dependent upon $\beta$ is only $-nI_0/\beta^2$. Comparing equations 25 and 10, it can be seen that the portion dependent upon $\beta$ in current switch 30 of FIG. 2 is substantially less than the dependent portion, $-nI_0/\beta$, in current switch 10 of FIG. 1.

Current switch 30 can also switch currents to loads 16 and 18 simultaneously, if so desired. In this situation, $V_{IN1}$ and $V_{IN2}$ have the first state so that Q1 and Q2 are on.

Since Q1 and Q2 are on and are identical transistors:

$$I_{CQ1}=I_{CQ2}\approx nI_0(1-1/\beta^2)/2 \quad 26.$$

As seen in equation 26, in current switch 30 of FIG. 2 the portion of the switched currents or currents through loads 16 and 18, $I_{CQ1}$ and $I_{CQ2}$, dependent upon $\beta$ is $-nI_0/2\beta^2$. This is substantially less than the $\beta$ dependent portion, $-nI_0/2\beta$, that would result in current switch of FIG. 1 if both Q1 and Q2 were on.

An advantage of the invention is that the switched current of current switch 30 is substantially less dependent on $\beta$ than that of current switch 10 of FIG. 1. As a result of the reduced $\beta$ dependence, the switched current of current switch 30 is much less sensitive to process variations than that of current switch 10 of FIG. 1 and can be predicted with a very high degree of accuracy.

Figure 3:
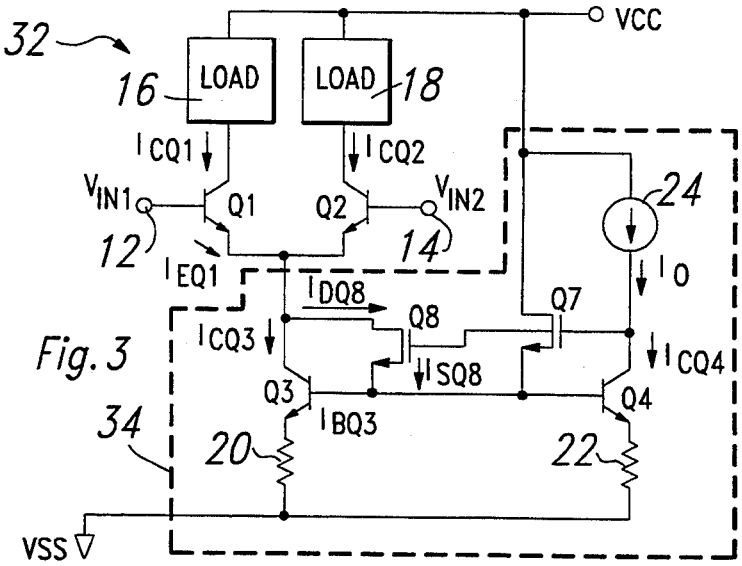
FIG. 3 is an electrical schematic diagram of a current switching circuit according to a second embodiment of the invention.

FIG. 3 shows an integrated circuit current switch 32 according to a second embodiment of the invention. Current switch 32 is identical to current switch 30 of FIG. 2 with the exception that NPN transistors Q5 and Q6 are replaced with n-channel field-effect transistors (FETs) Q7 and Q8. Transistor Q8 is n times larger than transistor Q7, where n is the emitter area scaling factor between transistors Q3 and Q4. The base electrodes of transistors Q3 and Q4 are coupled to the sources of transistors Q7 and Q8. The drain electrode of transistor Q7 is coupled to voltage source Vcc. The gate electrodes of transistors Q7 and Q8 are coupled to voltage source Vcc through constant current source 24. The drain electrode of transistor Q8 is coupled to the collector electrode of transistor Q3.

Elements Q3, Q4, Q7, Q8, 20, 22, and 24 form a bias circuit 34 which causes collector currents $I_{CQ1}$ and $I_{CQ2}$ to have predetermined values when transistors Q1 and Q2 are on. Transistor Q8 provides $\beta$ compensation for differential pair transistors Q1 and Q2 in the same manner transistor Q6 of FIG. 2 does as demonstrated by the following analysis in which $I_{DQN}$ is the drain current and $I_{SQN}$ is the source current of a transistor QN, where N is a number identifying a particular transistor.

When it is desired to switch current only to load 16, $V_{IN1}$ has the first state and $V_{IN2}$ has the second state so that Q1 is on and Q2 is off.

The gate current of transistor Q7 is negligible (Note that since Q7 is an FET, there is no $-I_0(n+1)/\beta^2$ contribution to $I_{CQ4}$), therefore:

$$I_{CQ4}=I_0 \quad 27.$$

Since Q3 mirrors Q4 and is emitter-scaled by a factor of n:

$$I_{CQ3}=nI_{CQ4}=nI_0 \quad 28.$$

Since the sum of currents at a node is 0:

$$I_{EQ1}=I_{CQ3}+I_{DQ8} \quad 29.$$

Since $I_{DQ8}=I_{SQ8}$ and since $I_{SQ8}=I_{BQ3}$:

$$I_{EQ1}=I_{CQ3}+I_{BQ3} \quad 30.$$

Since $I_{BQ3}=I_{CQ3}/\beta_{Q3}$:

$$I_{EQ1}=I_{CQ3}+I_{CQ3}/\beta_{Q3}=I_{CQ3}(1+1/\beta_{Q3}) \quad 31.$$

Since the sum of currents at a node is 0:

$$I_{CQ1}=I_{EQ1}-I_{BQ1} \quad 32.$$

Since $I_{BQ1}\approx I_{EQ1}/\beta_{Q1}$:

$$I_{CQ1}\approx I_{EQ1}-I_{EQ1}/\beta_{Q1}\approx I_{EQ1}(1-1/\beta_{Q1})$$

Substituting for $I_{EQ1}$ from equation 20:

$$I_{CQ1}\approx I_{CQ3}(1+1/\beta_{Q3})(1-1/\beta_{Q1} \quad 34.$$

Since $\beta_{Q3}\approx\beta_{Q1}$:

$$I_{CQ1}\approx I_{CQ3}(1-1/\beta^2) \quad 35.$$

Substituting for $I_{CQ3}$ from equation 17:

$$I_{CQ1}\approx nI_0(1-1/\beta^2) \quad 36.$$

As seen in equation 36, in current switch 32 of FIG. 3 the portion of the switched current or current through load 16, $I_{CQ1}$, dependent upon $\beta$ is only $-nI_0/\beta^2$. Comparing equations 36 and 10, it can be seen that the portion dependent upon $\beta$ in current switch 32 of FIG. 3 is substantially less than the dependent portion, $-nI_0/\beta$, in current switch 10 of FIG. 1.

Current switch 32 can also switch currents to loads 16 and 18 simultaneously, if so desired. In this situation, $V_{IN1}$ and $V_{IN2}$ have the first stet so that Q1 and Q2 are on.

Since Q1 and Q2 are on and are identical transistors:

$$_{CQ1}=I_{CQ2}\approx nI_0(1-1/\beta^2)/2$$

As seen in equation 37, in current switch 32 of FIG. 3 the portion of the switched currents or currents through loads 16 and 18, $I_{CQ1}$ and $I_{CQ2}$, dependent upon $\beta$ is $-nI_0/2\beta^2$. This is substantially less than the $\beta$ dependent portion, $-nI_0/2\beta$, that would result in current switch 10 of FIG. 1 if both Q1 and Q2 were on.

Figure 4:
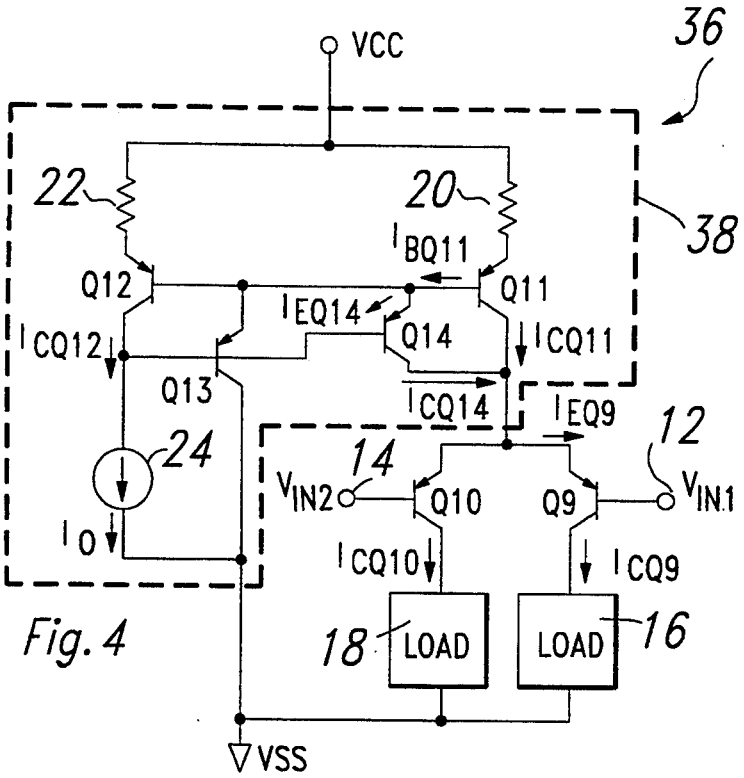
FIG. 4 is an electrical schematic diagram of a current switching circuit according to a third embodiment of the invention.

FIG. 4 shows an integrated circuit current switch 36 according to a third embodiment of the invention. Current switch 36 is a PNP transistor implementation of the current switch 30 of FIG. 2. Switch 36 includes a differential pair of identical bipolar PNP switching transistors Q9 and Q10. Transistor Q9 has a base electrode coupled to input terminal 12 to receive input signal $V_{IN1}$ and a collector electrode coupled to first voltage source Vss through load 16. Transistor Q10 has a base electrode coupled to input terminal 14 to receive input signal $V_{IN2}$ and a collector electrode coupled to voltage source Vss through load 18.

Input signals $V_{IN1}$ and $V_{IN2}$ selectively have either a first state or a second state. Transistor Q9 is turned on in response to the second state of signal $V_{IN1}$ to switch a current to load 16 and turned off in response to the first stat of signal $V_{IN1}$ to prevent current flow to load 16. Transistor Q10 is turned on in response to the second state of signal $V_{IN2}$ to switch a current to load 18 and turned off in response to the first state of signal $V_{IN2}$ to prevent current flow to load 18. Input signals $V_{IN1}$ and $V_{IN2}$ may be chosen so as to permit only one of transistors Q9 and Q10 to be on at any one time or to permit transistors Q9 and Q10 to be on simultaneously.

The emitter electrodes of transistors Q9 and Q10 are coupled in common to the collector electrodes of transistors Q11 and Q14 of a bias circuit 38 that causes collector currents $I_{CQ9}$ and $I_{CQ10}$ to have predetermined values when transistors Q9 and Q10 are on. Bias circuit 38 includes transistors Q11 and Q12 having emitter electrodes coupled to second voltage source Vcc through resistors 20 and 22, respectively. The base electrodes of transistors Q11 and Q12 are coupled to the emitter electrode of transistor Q13. The collector electrode of transistor Q13 is coupled to voltage source Vss. The collector electrode of transistor Q12 and base electrode of transistor Q13 are coupled to voltage source Vss through constant current source 24. Current source 24 produces a very accurate, constant reference current $I_0$.

Transistors Q11, Q12 and Q13 form a current mirror in which the collector current of Q12, $I_{CQ12}$, is mirrored by the collector current of Q11, $I_{CQ11}$. The emitter area of Q13 is the same as the emitter area of Q12. The emitter area of Q11 is scaled to be n times the size of the emitter area of Q12, where n may be any number but is typically greater than one. Resistor 22 is n times the value of resistor 20. The emitter area and resistor scaling results in $I_{CQ11}$ being n times as large as $I_{CQ12}$.

Transistor Q14 has an emitter electrode coupled to the base electrode of transistor Q11 and a base electrode coupled in common with the base electrode of transistor Q13. The emitter of transistor Q14 is the same size as the emitter of transistor Q11. Transistor Q14 provides $\beta$ compensation for differential pair transistor Q9 and Q10 in a manner similar to transistor Q6 of FIG. 2 as demonstrated by the following analysis.

When it is desired to switch current only to load 16, $V_{IN1}$ has the second state and $V_{IN2}$ has the first state so that Q9 is on and Q10 is off.

Neglecting the $-I_0(n+1)/\beta^2$ contribution to $I_{CQ4}$ for the reasons given with respect to equation 16 above:

$$I_{CQ12}=I_0 \qquad 38.$$

Since Q11 mirrors Q12 and is emitter-scaled by a factor of n:

$$I_{CQ11}=nI_{CQ12}=nI_0 \qquad 39.$$

Since the sum of currents at a node is 0:

$$I_{EQ9}=I_{CQ11}+I_{CQ14} \qquad 40.$$

Since $I_{CQ14}\approx I_{EQ14}$ and since $I_{EQ14}=I_{BQ11}$:

$$I_{EQ9}\approx I_{CQ11}+I_{BQ11} \qquad 41.$$

Since $I_{BQ11}=I_{CQ11}/\beta_{Q11}$:

$$I_{EQ9}\approx I_{CQ11}+I_{CQ11}/\beta_{Q11}\approx I_{CQ11}(1+1/\beta_{Q11}) \qquad 42.$$

Since the sum of currents at a node is 0:

$$I_{CQ9}=I_{EQ9}-I_{BQ9} \qquad 43.$$

Since $I_{BQ9}\approx I_{EQ9}/\beta_{Q9}$:

$$I_{CQ9}\approx I_{EQ9}-I_{EQ9}/\beta_{Q9}\approx I_{EQ9}(1-1/\beta_{Q9}) \qquad 44.$$

Substituting for $I_{EQ9}$ from equation 42:

$$I_{CQ9}\approx I_{CQ11}(1+1/\beta_{Q11})(1-1/\beta_{Q9}) \qquad 45.$$

Since $\beta_{Q11}\approx\beta_{Q9}$:

$$I_{CQ9}\approx I_{CQ11}(1-1/\beta^2)$$

Substituting for $I_{CQ11}$ from equation 39:

$$I_{CQ9}\approx nI_0(1-1/\beta^2)$$

As seen in equation 47, in current switch 36 of FIG. 4 the portion of the switched current or current through load 16, $I_{CQ9}$, dependent upon $\beta$ is only $-nI_0/\beta^2$. Comparing equations 47 and 10, it can be seen that the portion dependent upon $\beta$ in current switch 36 of FIG. 4 is substantially less than the dependent portion, $-nI_0/\beta$, in current switch 10 of FIG. 1.

Current switch 36 can also switch currents to loads 16 and 18 simultaneously, if so desired. In this situation, $V_{IN1}$ and $V_{IN2}$ have the second state so that Q1 and Q2 are on.

Since Q1 and Q2 are on and are identical transistors:

$$I_{CQ1}=I_{CQ2}\approx nI_0(1-1/\beta^2)/2 \qquad 48.$$

As seen in equation 48, in current switch 36 of FIG. 4 the portion of the switched currents or currents through loads 16 and 18, $I_{CQ1}$ and $I_{CQ2}$, dependent upon $\beta$ is $-nI_0/2\beta^2$. This is substantially less than the $\beta$ dependent portion, $-nI_0/2\beta$, that would result in current switch 10 of FIG. 1 if both Q1 and Q2 were on.

Figure 5:
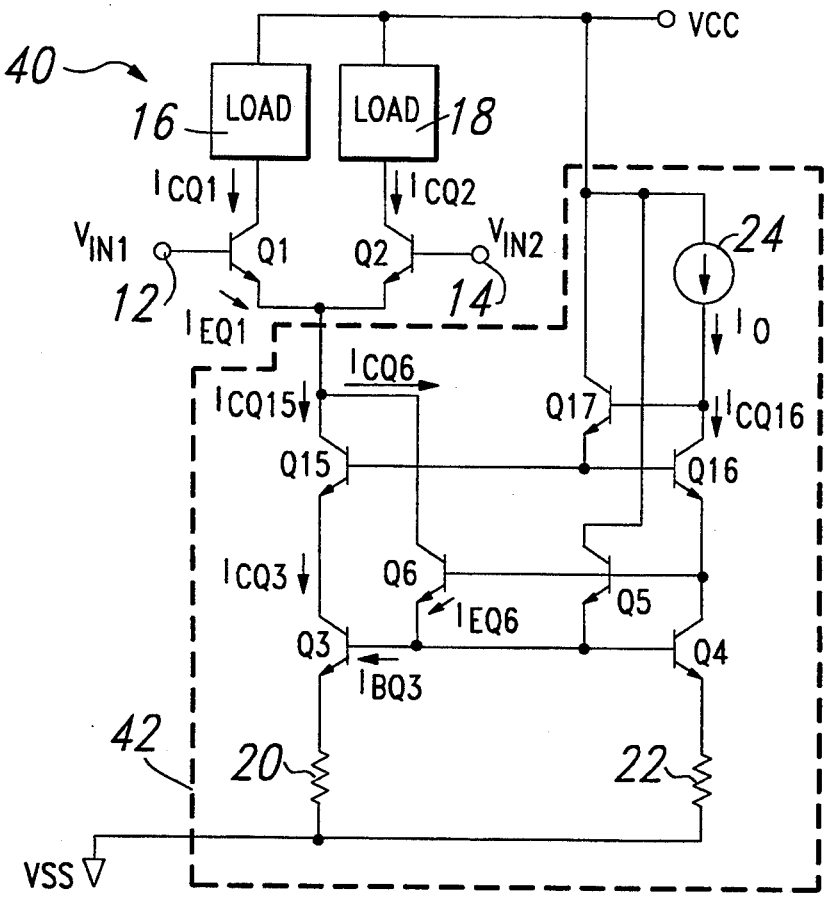
FIG. 5 is an electrical schematic diagram of a current switching circuit according to a fourth embodiment of the invention.

FIG. 5 shows an integrated circuit current switch 40 according to a fourth embodiment of the invention. Current switch 40 is identical to current switch 30 of FIG. 2 with the exception that transistors Q15, Q16, and Q17 are added. Transistor Q15 has a collector electrode coupled to the emitter electrodes of transistors Q1 and Q2, an emitter electrode coupled to the collector electrode of transistor Q3, and a base electrode coupled to the base electrode of transistor Q16 and the emitter electrode of transistor Q17. The collector electrode of transistor Q17 is coupled to voltage source Vcc. The base electrode of transistor Q17 and the collector electrode of transistor Q16 are coupled to voltage source Vcc through current source 24. The emitter electrode of transistor Q16 is coupled to the collector electrode of transistor Q4. Transistor Q3, Q4, Q5, Q15, Q16, and Q17 form a cascode current mirror. Transistor Q15, Q16, and Q17 have the same emitter areas as transistors Q3, Q4, and Q5, respectively.

Elements Q3, Q4, Q5, Q6, Q15, Q16, Q17, 20, 22, and 24 form a bias circuit 42 which causes collector currents $I_{CQ1}$ and $I_{CQ2}$ to have predetermined values when transistors Q1 and Q2 are on. Transistor Q6 provides $\beta$ compensation for switching transistors Q1 and Q2 to permit them to switch currents $I_{CQ1}$ and $I_{CQ2}$, respectively, that are substantially less dependent on $\beta$ and therefore much less sensitive to process variations as demonstrated by the following analysis.

When it is desired to switch current only to load 16, $V_{IN1}$ has the first state and $V_{IN2}$ has the second state so that Q1 is on and Q2 is off.

Neglecting the $-I_0(n+1)/\beta^2$ contribution to $I_{CQ6}$ for the reasons given with respect to equation 16 above:

$$I_{CQ16}=I_0 \quad 49.$$

Since Q15 mirrors Q16 and is emitter-scaled by a factor of n:

$$I_{CQ15}=nI_{CQ16}=nI_0 \quad 50.$$

Since the sum of currents at a node is 0:

$$I_{EQ1}=I_{CQ15}+I_{CQ6} \quad 51.$$

Since $I_{CQ5}\approx I_{EQ6}$ and since $I_{EQ6}=I_{BQ3}$:

$$I_{EQ1}\approx I_{CQ15}+I_{BQ3} \quad 52.$$

Since $I_{BQ3}=I_{CQ3}/\beta_{Q3}$ and $I_{CQ3}=I_{EQ15}$:

$$I_{EQ1}\approx I_{CQ15}+I_{EQ15}/\beta_{Q3} \quad 53.$$

Since $I_{EQ15}=I_{CQ15}+I_{BQ15}$ and $I_{BQ15}=I_{CQ15}/\beta_{Q15}$ $$I_{EQ1}\approx I_{CQ15}+[I_{CQ15}+I_{CQ15}/\beta_{Q15}]/\beta_{Q3} \quad 54.$$

Since $\beta_{Q15}\approx\beta_{Q3}$:

$$I_{EQ1}\approx I_{CQ15}(1+1/\beta+1/\beta^2) \quad 55.$$

Since the sum of currents at a node is 0:

$$I_{CQ1}=I_{EQ1}-I_{BQ1} \quad 56.$$

Since $I_{BQ1}\approx I_{EQ1}/\beta_{Q1}$:

$$I_{CQ1}\approx I_{EQ1}-I_{EQ1}/\beta_{Q1}\approx I_{EQ1}(1-1/\beta_{Q1}) \quad 57.$$

Substituting for $I_{EQ1}$ from equation 55:

$$I_{CQ1}\approx I_{CQ15}(1-1/\beta_{Q1})(1+1/\beta^2) \quad 58.$$

Since $\beta_{Q1}\approx\beta$ of all other transistors:

$$I_{CQ1}\approx I_{CQ15}[(1+1/\beta^2)-(1/\beta+1/\beta^2+1/\beta^3)]\approx I_{CQ15}(1-1/\beta^3) \quad 59.$$

Substituting for $I_{CQ15}$ from equation 50:

$$I_{CQ1}=nI_0(1-1/\beta^3) \quad 60.$$

As seen in equation 60, in current switch 40 of FIG. 5 the portion of the switched current or current through load 16, $I_{CQ1}$, dependent upon $\beta$ is only $-nI_0/\beta^3$. Comparing equations 60 and 10, it can be seen that the portion dependent upon $\beta$ in current switch 40 of FIG. 5 is substantially less than the dependent portion, $-nI_0/\beta$, in current switch 10 of FIG. 1.

Current switch 40 can also switch currents to loads 16 and 18 simultaneously, if so desired. In this situation, $V_{IN1}$ and $V_{IN2}$ have the first state so that Q1 and Q2 are on.

Since Q1 and Q2 are on and are identical transistors:

$$I_{CQ1}=I_{CQ2}\approx nI_0(1-1/\beta^3)/2 \quad 61.$$

As seen in equation 61, in current switch 40 of FIG. 5 the portion of the switched currents or currents through loads 16 and 18, $I_{CQ1}$ and $I_{CQ2}$, dependent upon $\beta$ is $-nI_0/2\beta^3$. This is substantially less than the $\beta$dependent portion, $-nI_0/2\beta$, that would result in current switch 10 of FIG. 1 if both Q1 and Q2 were on.

N-channel field effect transistors (FETs) could be substituted for bipolar transistors Q5 and Q6. N-channel field effect transistors could also e substituted for bipolar transistors Q15 and Q16 in which case transistor Q17 would be replaced with a conductor shorting the gate and drain of the n-channel field effect transistor replacing Q16. In addition, current switch 40 could be implemented with PNP transistors instead of NPN transistors or a combination of PNP transistors and p-channel field effect transistors.

An advantage of the invention, as demonstrated by each of the embodiments of FIGS. 2–5, is the ability of a current switch having bipolar switching transistors to switch a current that is substantially less dependent on $\beta$ than the current switched by the conventional current switch of FIG. 1. The substantial reduction in $\beta$ dependence results in a switched current that is much less sensitive to process variations and can therefore be predicted with a very high degree of accuracy.

A few preferred embodiments have been described in detail hereinabove. It is to be understood that the scope of the invention also comprehends embodiments different from those described, yet within the scope of the claims.

For example, the number of switching transistors and associated loads may be greater than two or less than two. In addition, instead of being fully integrated, the circuit may be implemented in discrete components.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A current switch, comprising:

at least one switching transistor having a collector electrode for coupling to a first voltage source, an emitter electrode, and a base electrode for receiving a control signal, said at least one switching transistor responsive to said control signal to turn on to produce a collector current; and a bias circuit for causing said collector current to have a predetermined value when said at least one switching transistor is on, said bias circuit including:

first and second transistors having base electrodes coupled in common, said first transistor having a collector electrode coupled to the emitter electrode of said at least one switching transistor and an emitter electrode for coupling to a second voltage source, said second transistor having a collector electrode for coupling to a current source and an emitter electrode for coupling to said second voltage source; and a third transistor having a collector electrode coupled to the emitter electrode of said at least one switching transistor, an emitter electrode coupled to the base electrode of said first transistor, and a base electrode coupled to the collector electrode of said second transistor.

2. The current switch of claim 1 in which said at least one switching transistor has a current gain $\beta$, said third transistor reducing the dependence of said collector current of said at least one switching transistor on the current gain $\beta$.

3. The current switch of claim 1 further including a load coupled between the collector electrode of said at least one switching transistor and said first voltage source.

4. The current switch of claim 1 in which said at least one switching transistor includes a plurality of switching transistors, each of said switching transistors having a collector electrode for coupling to said first voltage source, an emitter electrode coupled to the collector electrode of said first transistor and to the first electrode of said third transistor, and a base electrode for receiving a control signal, each of said plurality of switching transistors responsive to said control signal to turn on to produce a collector current.

5. The current switch of claim 1 in which said at least one switching transistor, said first and second transistors, and said third transistor are NPN transistors.

6. The current switch of claim 1 in which said at least one switching transistor, said first and second transistors, and said third transistor are PNP transistor.

7. The current switch of claim 1 in which said bias circuit further includes a fourth transistor having a collector electrode for coupling to said first voltage source, an emitter electrode coupled to the base electrodes of said first and second transistors, and a base electrode coupled to the collector electrode of said second transistor.

8. The current switch of claim 1 in which said bias circuit further includes:

a fourth transistor having a collector electrode coupled to the emitter electrode of said at least one switching transistor, an emitter electrode coupled to the collector electrode of said first transistor, and a base electrode; and a fifth transistor having a collector electrode coupled to said current source, an emitter electrode coupled to the collector electrode of said second transistor, and a base electrode coupled to the base electrode of said fourth transistor.

9. The current switch of claim 8 in which said bias circuit further includes:

a sixth transistor having a collector electrode coupled to said first voltage source, an emitter electrode coupled to the base electrodes of said first and second transistors, and a base electrode coupled to the collector electrode of said second transistor.

10. The current switch of claim 9 in which said bias circuit further includes:

a seventh transistor having a collector electrode coupled to said first voltage source, an emitter electrode coupled to the control electrodes of said fourth and fifth transistors, and a base electrode coupled to the collector electrode of said fifth transistor.

11. A current switch, comprising:

at least one switching transistor having a collector electrode for coupling to a first voltage source, an emitter electrode, a base electrode for receiving a control signal, and a current gain $\beta$, said at least one switching transistor responsive to said control signal to turn on to produce a collector current; and a bias circuit for causing said collector current to have a predetermined value when said at least one switching transistor is on, said bias circuit including:

first and second transistors having base electrodes coupled in common, said first transistor having a collector electrode coupled to the emitter electrode of said at least one switching transistor and an emitter electrode for coupling to a second voltage source, said second transistor having a collector electrode for coupling to a current source and an emitter electrode for coupling to said second voltage source; and a compensating circuit coupled to the emitter electrode of said at least one switching transistor for reducing the dependence of said collector current of said at least one switching transistor on said current gain 62 , said compensating circuit including a third transistor having a collector electrode coupled to the emitter electrode of said at least one switching transistor, an emitter electrode coupled to the base electrode of said first transistor, and a base electrode coupled to the collector electrode of said second transistor.

12. A current switch, comprising:

at least one switching transistor having a collector electrode for coupling to a first voltage source, an emitter electrode, and a base electrode for receiving a control signal, said at least one switching transistor responsive to said control signal to turn on to produce a collector current; and a bias circuit for causing said collector current to have a predetermined value when said at least one switching transistor is on, said bias circuit including:

first and second transistors having base electrodes coupled in common, said first transistor having a collector electrode coupled to the emitter electrode of said at least one switching transistor and an emitter electrode for coupling to a second voltage source, said second transistor having a collector electrode for coupling to a current source and an emitter electrode for coupling to said second voltage source; and a third transistor having a drain electrode coupled to the emitter electrode of said at least one switching transistor, a source electrode coupled to the base electrode of said first transistor, and a gate electrode coupled to the collector electrode of said second transistor.

13. The current switch of claim 12 in which said at least one switching transistor has a current gain $\beta$, said third transistor reducing the dependence of said collector current of said at least one switching transistor on the current gain $\beta$.

14. The current switch of claim 12 further including a load coupled between the collector electrode of said at least one switching transistor and said first voltage source.

15. The current switch of claim 12 in which said at least one switching transistor includes a plurality of switching transistors, each of said switching transistors having a collector electrode for coupling to said first voltage source, and emitter electrode coupled to the collector electrode of said first transistor and to the first electrode of said third transistor, and a base electrode for receiving a control signal, each of said plurality of switching transistors responsive to said control signal to turn on to produce a collector current.

16. The current switch of claim 12 in which said at least one switching transistor and said first and second transistors are NPN transistors and said third transistor is an n-channel field effect transistor.

17. The current switch of claim 12 in which said bias circuit further includes a fourth transistor having a drain electrode for coupling to said first voltage source, a source electrode coupled to the base electrodes of said first and second transistors, and a gate electrode coupled to the collector electrode of said second transistor.

18. A current switch, comprising:

at least one switching transistor having a collector electrode for coupling to a first voltage source, an emitter electrode, a base electrode for receiving a control signal, and a current gain $\beta$, said at least one switching transistor responsive to said control signal to turn on to produce a collector current; and a bias circuit for causing said collector current to have a predetermined value when said at least one switching transistor is on, said bias circuit including:

first and second transistors having base electrodes coupled in common, said first transistor having a collector electrode coupled to the emitter electrode of said at least one switching transistor and an emitter electrode for coupling to a second voltage source, said second transistor having a collector electrode for coupling to a current source and an emitter electrode for coupling to said second voltage source: and a compensating circuit coupled to the emitter electrode of said at least one switching transistor for reducing the dependence of said collector current of said at least one switching transistor on said current gain $\beta$, said compensating circuit including a third transistor having a drain electrode coupled to the emitter electrode of said at least one switching transistor, a source electrode coupled to the base electrode of said first transistor, and a gate electrode coupled to the collector electrode of said second transistor.

* * * * *